US006910427B2

(12) United States Patent
Woodall et al.

(10) Patent No.: US 6,910,427 B2
(45) Date of Patent: Jun. 28, 2005

(54) SECURITY DEVICE AND METHOD TO PREVENT UNAUTHORIZED DISCHARGE OF CONTENTS FROM A TANK

(75) Inventors: Wade J. Woodall, Garland, TX (US); Thomas H. Dalrymple, Duncanville, TX (US)

(73) Assignee: TRN Business Trust, Dallas, TX (US)

( * ) Notice: Subject to any disclaimer, the term of this patent is extended or adjusted under 35 U.S.C. 154(b) by 34 days.

(21) Appl. No.: 10/683,942

(22) Filed: Oct. 10, 2003

(65) Prior Publication Data

US 2004/0074416 A1 Apr. 22, 2004

Related U.S. Application Data

(60) Provisional application No. 60/418,650, filed on Oct. 15, 2002.

(51) Int. Cl.[7] ..... B61D 5/00

(52) U.S. Cl. ..... 105/358; 105/377.07

(58) Field of Search ..... 105/358, 377.01, 105/377.04, 377.07, 377.08, 377.11, 378; 220/565, 200, 253, 254.1

(56) References Cited

U.S. PATENT DOCUMENTS

| | | | | |
|---|---|---|---|---|
| 3,142,410 A | | 7/1964 | Arnold | 220/41 |
| 4,287,999 A | | 9/1981 | Hesterberg | 220/222 |
| 4,371,090 A | | 2/1983 | Ogarek et al. | 220/224 |
| 4,673,102 A | | 6/1987 | Bullock, Jr. | 220/457 |
| 4,685,585 A | | 8/1987 | Robbins | 220/256 |
| 5,011,038 A | | 4/1991 | Schultz | 220/320 |
| 5,056,680 A | | 10/1991 | Sharp | 220/465 |
| 6,053,113 A | | 4/2000 | Shaddle | 105/377.07 |
| 6,076,471 A | * | 6/2000 | Burian et al. | 105/377.07 |
| 6,105,805 A | | 8/2000 | Labelle et al. | 220/262 |
| 6,216,603 B1 | | 4/2001 | Shaddle | 105/377.07 |
| 6,253,801 B1 | | 7/2001 | Lie | 141/50 |
| 6,328,064 B1 | | 12/2001 | Garfield | 137/590 |
| 6,390,119 B1 | * | 5/2002 | Crochet et al. | 137/347 |
| 6,557,477 B1 | * | 5/2003 | Degutis et al. | 105/358 |

* cited by examiner

*Primary Examiner*—S. Joseph Morano
*Assistant Examiner*—Robert J. McCarry, Jr
(74) *Attorney, Agent, or Firm*—Baker Botts L.L.P.

(57) ABSTRACT

Security devices are provided to prevent or block unauthorized access through portholes formed in a protective housing assembly when the protective housing assembly is in its first, closed position and to allow access through the portholes when the protective housing assembly is in its second, open position. The protective housing assembly may be mounted on an upper portion of a railway tank car to protect valves, fittings and other components associated with loading and unloading of lading from the tank car. The portholes are typically formed in the protective housing assembly to allow access to an adjacent valve or other component. Each porthole cover may be engaged with a normal access cover of the protective housing assembly to block or restrict access through the respective porthole.

21 Claims, 7 Drawing Sheets

SECURITY DEVICE AND METHOD TO PREVENT UNAUTHORIZED DISCHARGE OF CONTENTS FROM A TANK

RELATED APPLICATIONS

This application claims priority to U.S. Provisional Patent Application Ser. No. 60/418,650, entitled Security Device and Method to Prevent Unauthorized Discharge of Contents from a Tank, filed Oct. 15, 2002, which is hereby incorporated by reference.

TECHNICAL FIELD

The present invention is related to railway tank cars and more particularly to security devices to prevent unauthorized access to valves, fittings and other components associated with such tank cars.

BACKGROUND OF THE INVENTION

Tank cars have been used for many years to transport a wide variety of commodities including liquids, gasses and other fluids. The contents of a tank car may sometimes be potentially hazardous if appropriate safety precautions are not taken. Also, the contents of a tank car may be valuable and subject to theft or misappropriation.

Most tank cars are designed with an access opening or manway located in the upper portion of the associated tank, proximate a midpoint between opposite ends of the tank car. A manway cover is typically bolted or otherwise secured to the opening to allow only limited access by personnel to the interior of the tank. Various pipes, valves, fittings and other components are also often located in the vicinity of the manway to control adding and discharging lading from the tank car. The valves, fittings and other components are typically selected based on characteristics and properties of the commodity or lading being transported.

Valves, fittings and other components are often mounted on the manway cover of modern pressurized tank cars. Pressure car fittings typically include two "liquid or fluid" valves for loading and unloading of an associated commodity. Respective check valves and induction piping are also provided with respective loading and unloading valves. One or more vapor valves, gauging devices and safety relief valves may also be mounted on the manway cover. Some tank cars may have smaller valves for drawing samples of lading and thermal wells for measuring the temperature of the lading. Non-pressurized tank cars may also have similar valves and fittings mounted on a manway cover similar to a pressurized tank car.

Various types of protective housing assemblies or dome structures are often disposed on the upper portion of a tank car adjacent to the manway to protect associated piping, valves, fittings and other components. All pressurized tank cars are required to have such protective housing assemblies or dome structures covering any pipes, valves, fittings and other components located on an upper portion of the pressurized tank car. A relatively thick, steel ring or cylindrical portion is often provided to protect the valves, fittings, and other components in the event the tank car is derailed and overturns.

Protective housing assemblies and/or dome covers on a typical railway tank car will often include one or more openings which provide access through a sidewall or cylindrical portion of the protective housing to facilitate loading and/or unloading of products carried by the tank car. Multiple ports or openings (sometimes referred to as "portholes") formed in a protective housing assembly allow access to operate respective valves and fittings disposed within the protective housing assembly. Most portholes have a hinged, flap type cover that may be easily opened and closed as required to provide access through the porthole to an adjacent valve or fitting. Other portholes or openings may remain open without any cover. Unauthorized access may often be obtained to valves and/or fittings used to load or unload tank cars by simply moving these unsecured covers and reaching into the protective housing assembly to manipulate the associated valves and fittings.

SUMMARY OF THE INVENTION

In accordance with teachings of the present invention, security devices and methods are provided to prevent unauthorized access to, and unauthorized operation of valves, fittings or other components associated with discharging fluids from a railway tank car. The security devices may include respective porthole covers that restrict or block access to such components when an associated protective housing assembly has been properly closed and secured. The security devices and associated porthole covers are designed to prevent and/or minimize any damage to the porthole covers, protective housing assembly, fittings and/or valves during an attempt to gain unauthorized access to the valves and fittings.

In accordance with a particular embodiment of the present invention a protective housing assembly includes a cylindrical sidewall configured to be coupled with a tank to generally surround at least one valve of the tank. An access cover is configured to be removably disposed over the cylindrical sidewall. A diameter of the access cover is slightly larger than a diameter of the cylindrical sidewall, such that an outer portion of the access cover overhangs the cylindrical sidewall, when the access cover is in a first, closed position. A hinge assembly is coupled to the cylindrical sidewall and the access cover, and is configured to allow the access cover to be moved to a second, open position wherein an interior portion of the cylindrical sidewall is exposed to a user. The cylindrical sidewall may have at least one porthole disposed therein. The protective housing assembly also includes a porthole cover having a first position in which the porthole cover covers the porthole, and a second position in which the porthole is exposed. In accordance with a particular embodiment, the access cover prevents the porthole cover from being moved from the first position to the second position, when the access cover is in the closed position.

The protective housing assembly may also include a pivot pin that is disposed through the porthole cover and coupled to the cylindrical wall. The pivot pin allows rotation of the porthole cover from the first position to the second position. In accordance with one embodiment, the porthole cover is disposed upon an exterior surface of the cylindrical wall. In this embodiment, the upper portion of the access cover may cooperate with an upper edge of the porthole cover to prevent the porthole cover from being rotated from the first position to the second position, when the access cover is in the closed position.

In accordance with another embodiment, the access cover may form at least one slot in the outer portion of the access cover. In this embodiment, an upper portion of the porthole cover may be disposed in the slot, to prevent rotation of the porthole cover from the first position to the second position, when the access cover is in the closed position.

Technical benefits of the present invention include preventing unauthorized access to valves, fittings or components such as loading and unloading valves associated with a tank car. Security devices formed in accordance with teachings of the present invention prevent or block access through portholes or openings which are often formed in protective housing assemblies associated with tank cars. The security devices prevent operation of unloading valves or other components which would allow unauthorized removal of fluids from a tank car or unauthorized release of potentially hazardous fluids to the surrounding environment. Anhydrous ammonia is one example of a commodity that may be stolen from tank cars. Security devices incorporating teachings of the present invention prevent unauthorized access to valves and fittings used to control loading and unloading of lading from a tank car and at the same time allow normal loading and unloading procedures when proper access is obtained by opening the protective housing assembly.

Further technical benefits of the present invention include providing security devices which are relatively light weight and may be manufactured with relatively low cost. Such security devices may be activated or deactivated by normal opening or closing of an associated protective housing assembly or dome structure. The security devices may be formed as integral components of a protective housing assembly or dome structure. Alternatively, security devices formed in accordance with teachings of the present invention may be added on to an existing housing assembly or dome structure. Security devices incorporating teachings of the present invention do not interfere with normal emergency response procedures in the event of damage to an associated tank car or other emergency conditions.

BRIEF DESCRIPTION OF THE DRAWINGS

A more complete understanding of the present embodiments and advantages thereof may be acquired by referring to the following description, taken in conjunction with the accompanying drawings, in which like reference numbers indicate like features, and wherein.

DETAILED DESCRIPTION OF THE INVENTION

Embodiments of the invention and its advantages are best understood by reference to FIGS. 1–7B, wherein like numbers refer to same and like parts.

Various aspects of the present invention will be described with respect to a railway tank car satisfactory for carrying pressurized fluids. Such railway cars may sometimes be referred to as "pressure tank cars". A protective housing assembly or dome assembly formed in accordance with teachings of the present invention may also be satisfactorily used on non-pressure tank cars to prevent unauthorized access to valves, fittings or other components which control loading or unloading of commodities carried by such tank cars. A protective housing assembly with one or more security devices formed in accordance with teachings of the present invention may also be used on other types of railway cars and other types of tanks such as tanks on highway trucks, tanks carried on barges and storage tanks located at either temporary or permanent facilities. The present invention is not limited to use with railway tank cars.

The terms "engage", "engaged" and "engagement" are used in this application to describe various types of attachments, couplings, connections or mountings between one or more security devices and a protective housing assembly formed in accordance with teachings of the present invention. For example the term "engagement" may be used to describe a slideable connection between a security device and portions of a protective housing assembly. Engagement may be used to describe a rotatable or pivotable attachment between a security device and portions of a protective housing assembly. For some embodiments, the terms "engage", "engaged" and "engagement" may be used to describe forming a security device as an integral component of a protective housing assembly. For other embodiments, the terms "engage", "engaged" and "engagement" may be used to describe adding one or more security devices to an existing protective housing assembly.

Figure 1:
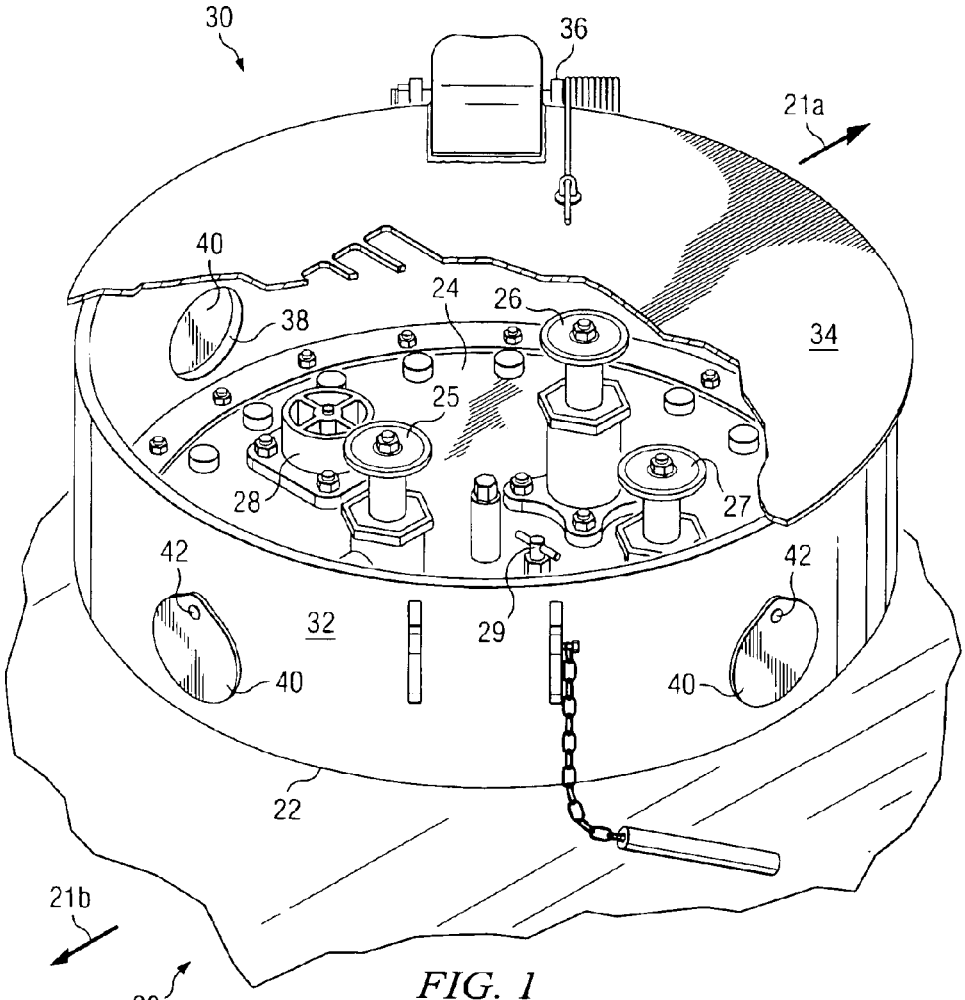
FIG. 1 (PRIOR ART)
FIG. 1 is a schematic drawing in elevation, with portions broken away, showing a conventional protective housing assembly or dome assembly mounted on a tank car surrounding a manway of the tank car, with the protective housing assembly in its first, closed position.

FIG. 1 illustrates portions of a railway tank car 20 with a conventional protective housing assembly 30 mounted thereon. Tank car 20 preferably includes manway or access opening 22 located in an upper portion thereof, proximate a midpoint between opposite ends 21*a* and 21*b* of tank car 20. Protective housing assembly 30 includes a generally hollow, cylindrical portion 32 and lid or normal access cover 34. Hinge assembly 36 allows lid 34 to rotate between a first, closed position, as shown in FIG. 1, and a second, open position (not expressly shown). Cylindrical portion 32 may sometimes be referred to as a sidewall.

A protective housing assembly formed in accordance with teachings of the present invention may have various configurations and dimensions. The present invention is not limited to use with protective housing assemblies which have a generally hollow cylindrical portion or cylindrical sidewalls. A protective housing assembly having sidewalls with a wide variety of geometric configurations such as square, rectangular, triangular, etc. may be formed with security devices in accordance with teachings of the present invention.

The dimensions of cylindrical portion 32 may be selected to accommodate the outside diameter of manway 22 and manway cover 24, to allow cylindrical portion 32 to generally surround the valves in manway cover 24. Various valves and fittings designated 25, 26, 27, 28 and 29 may be mounted on manway cover 24 to control loading and unloading of commodities from tank car 20. Protective housing assembly 30 prevents damage to valves and fittings 25 through 29 in the event tank car 20 is derailed and turns over. One of these valves will typically be a safety valve that discharges fluid from tank car 20 when the pressure of fluid contained therein exceeds a predetermined, maximum value.

A vent opening or discharge opening may also be formed in normal access cover 34 to allow any fluids discharged from the safety valve to exit from protective housing assembly 30. The vent opening may also have a respective cover which opens and closes in response to any fluids discharged from the associated safety valve.

A plurality of portholes or openings 38 may be formed in cylindrical portion 32 of protective housing assembly 30. Respective porthole covers 40 may be mounted on the exterior of cylindrical portion 32 adjacent to each porthole 30. For the example shown in FIG. 1, portholes 38 and porthole covers 40 have generally circular configurations. Pivot pin 42 may be used to rotatably or pivotally mount each porthole cover 40 adjacent to respective porthole opening 38. Porthole covers 40 may be rotated from a first closed position as shown in FIG. 1 to a second, open position (not expressly shown) which allows access to and/or operation of adjacent valves 25 through 29.

Figure 2:
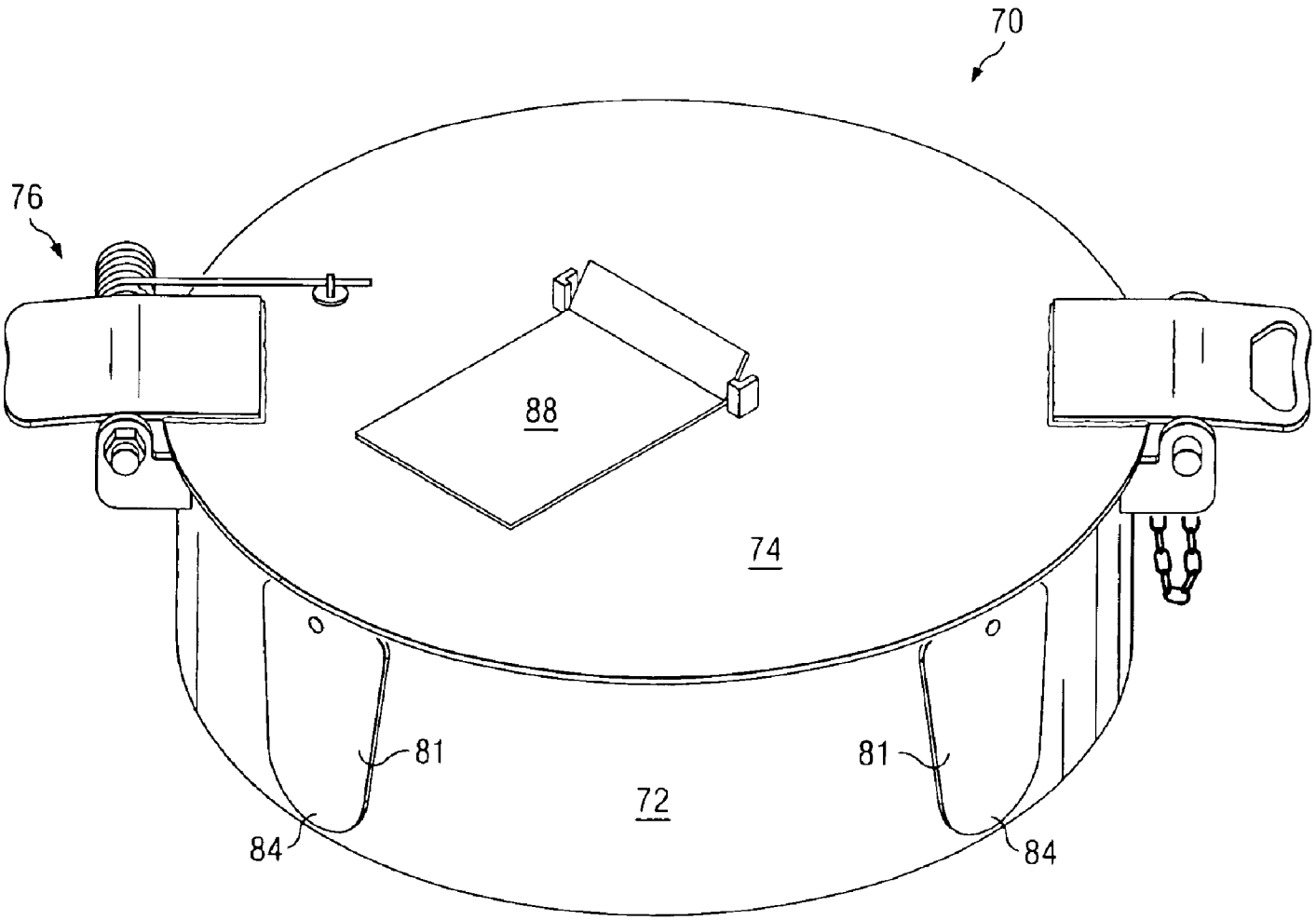
FIG. 2 is a schematic drawing showing an isometric view of a protective housing assembly formed in accordance with teachings of the present invention in its first, closed position which may block unauthorized access to valves, fittings or other components which control loading and unloading of commodities carried by an associated railway tank car (not shown)
Figure 3A:
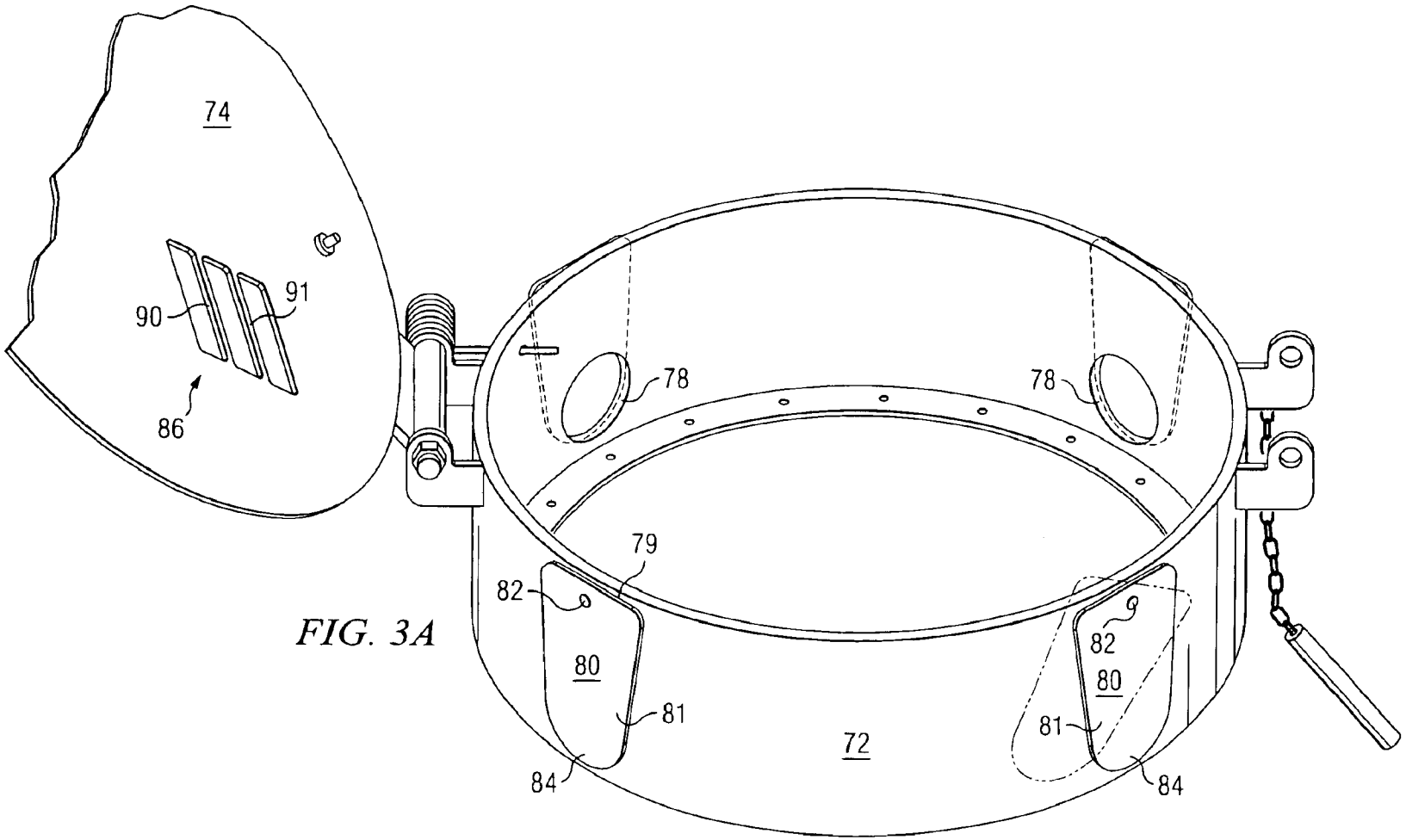
FIG. 3A is a schematic drawing showing the protective housing assembly of FIG. 2 in its second, open position, which provides normal access to associated valves, fittings and other components.

FIGS. 2 and 3A illustrate protective housing assembly 70 formed in accordance with teachings of the present invention. Protective housing assembly 70 may include cylindrical portion 72, normal access cover 74 and hinge assembly 76. For the embodiment of the present invention as represented by protective housing assembly 70, portholes 78 have a generally circular configuration. The dimensions associated with cylindrical portion 72, normal access cover 74 and portholes 78 may correspond approximately with similar dimensions and configuration of cylindrical portion 32, normal access cover 34 and portholes 38, of FIG. 1.

Protective housing assembly 70 is shown in FIG. 2 in its first, closed position with normal access cover 74 blocking access to an associated manway, manway cover and any valves or fittings disposed on the manway cover. FIG. 3A shows protective housing assembly 70 in its second, open position which allows access to the associated manway cover and any valves or fittings disposed thereon.

For the embodiment of the present invention as shown in FIGS. 2 and 3A, protective housing assembly 70 preferably includes at least four portholes 78 and at least four porthole covers 80, respectively disposed on portholes 78. FIG. 2 illustrates porthole covers 80 in their first, closed position blocking access through the respective porthole 80. In FIG. 3A, one of the porthole covers 80 is shown in its second, open position (dotted lines), which allows access through the respective porthole 78.

Respective pivot pins 82 may be used to rotatably or pivotally mount each porthole cover 80 adjacent to respective porthole opening 78. The length of porthole covers 80 is selected such that when each porthole cover 80 is in its first position, the respective porthole cover 80 will extend from immediately adjacent to normal access cover 74 and cover the associated porthole 78. The width of porthole covers 80 is preferably selected to be larger than the diameter of the associated porthole 78.

For the embodiment of the present invention as shown in FIGS. 2 and 3A, first end 81 of porthole cover 80 has an increased width that cooperates with normal access cover 74 to prevent rotation of each respective porthole cover 80 from its first position to its second position, when normal access cover 74 is in its first, closed position. The second end 84 of each porthole cover 80 may have a generally curved or accurate surface. The length of porthole covers 80 may be selected to be slightly less than the height of cylindrical portion or sidewall 72.

The dimensions and configuration of porthole covers 80 are selected to prevent the opening of porthole covers 80 when normal access cover 74 is in the closed position. As illustrated in FIG. 2, normal access cover 74 overhangs cylindrical portion 72 and an upper edge 79 of porthole cover 80, at first end 81. Since porthole cover 80 is rotatably mounted to cylindrical portion 72 using pivot pins 82, the cooperation of the upper edge of porthole cover 80 at first end 81 with the overhanging portion of normal access cover 74 prevents porthole cover 80 from rotating in either direction (clockwise or counterclockwise) with respect to pivot pin 82. Thus, when normal access cover is locked or latched in the closed position, unauthorized access to the interior of protective housing assembly 70 is prevented.

In the illustrated embodiment, porthole cover 80 is formed from a metal plate that may generally conform to the circumference of cylindrical portion 72. As long as the edge of normal access cover 74 overhangs at least a portion of the edge of the plate at first end 81, porthole cover 80 will be prevented from rotating when normal access cover 74 is in its closed position.

Various configurations are available for porthole cover 80, within the teachings of the present invention. In the illustrated embodiment, porthole cover 80 is generally a rectangular configuration proximate first end 81. This configuration enhances the cooperation between porthole cover 80 and normal access cover 74 to prevent rotation of porthole covers 80 to expose portholes 78, when normal access cover 74 is in the closed position. The second end 84 is arcuate and generally conforms to the curvature of porthole 78, in order to fully cover porthole 78 when porthole 80 is in the closed position. Other sizes, configurations and features of porthole covers, portholes, and normal access covers that help prevent unauthorized access to the interior of the protective housing assembly are described herein.

Lid or normal access cover 74 may also include vent opening 86 and vent opening cover or flap 88. A plurality of restrictions 90 and 91 are formed within vent opening 86 to prevent unauthorized access through normal access cover 74 when protective housing assembly 70 is in its first, closed position. For the embodiment of the present invention as shown in FIG. 3A, restrictions 90 and 91 may be bars formed as integral components of normal access cover 74. For other applications which will be discussed later in more detail, other types of restrictions, such as heavy metal screens may be engaged with an interior surface of a normal access cover 74 adjacent to an associated vent opening, to allow any fluids discharged from a safety valve to escape therethrough and at the same time to prevent access through the vent opening to one or more valves disposed within the associated protective housing assembly.

Figure 3B:
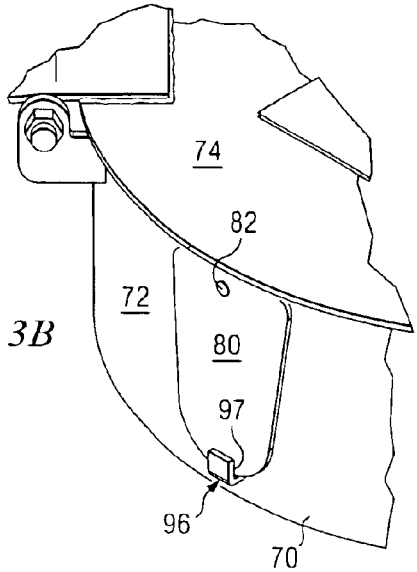
FIG. 3B is a schematic drawing in elevation, with portions broken away, illustrating an optional anti-bending lug that may be used with the protective housing assembly of FIGS. 2 and 3A.

FIG. 3B illustrates an additional feature that may be incorporated into protective housing assembly 70, of FIGS. 2 and 3. An anti-bending lug 96 is incorporated into protective housing assembly 70, to further prevent unauthorized access to the interior of protective housing assembly 70. Anti-bending lugs 96 prevent an unauthorized user from prying porthole cover 80 away from cylindrical portion 72 to potentially fracture pin 82 and/or allow rotation of porthole cover 80 about pin 82 when normal access cover 74 is in the closed position.

Anti-bending lugs 96, in the illustrated embodiment, comprise metal angles that are affixed to protective housing assembly 70, independent of porthole cover 80. Therefore, porthole cover 80 may slide through a gap between an upper leg 97 of anti-bending lug 96, and cylindrical portion 72 of protective housing assembly 70. Anti-bending lugs 96 may be welded or otherwise affixed to a lower edge of cylindrical portion 72, or welded or otherwise affixed to another portion of protective housing assembly 70 (other than porthole cover 80). In an alternative embodiment, anti-bending lug 96 may be formed integrally with cylindrical portion 72 or another component of protective housing assembly 70.

Figure 4:
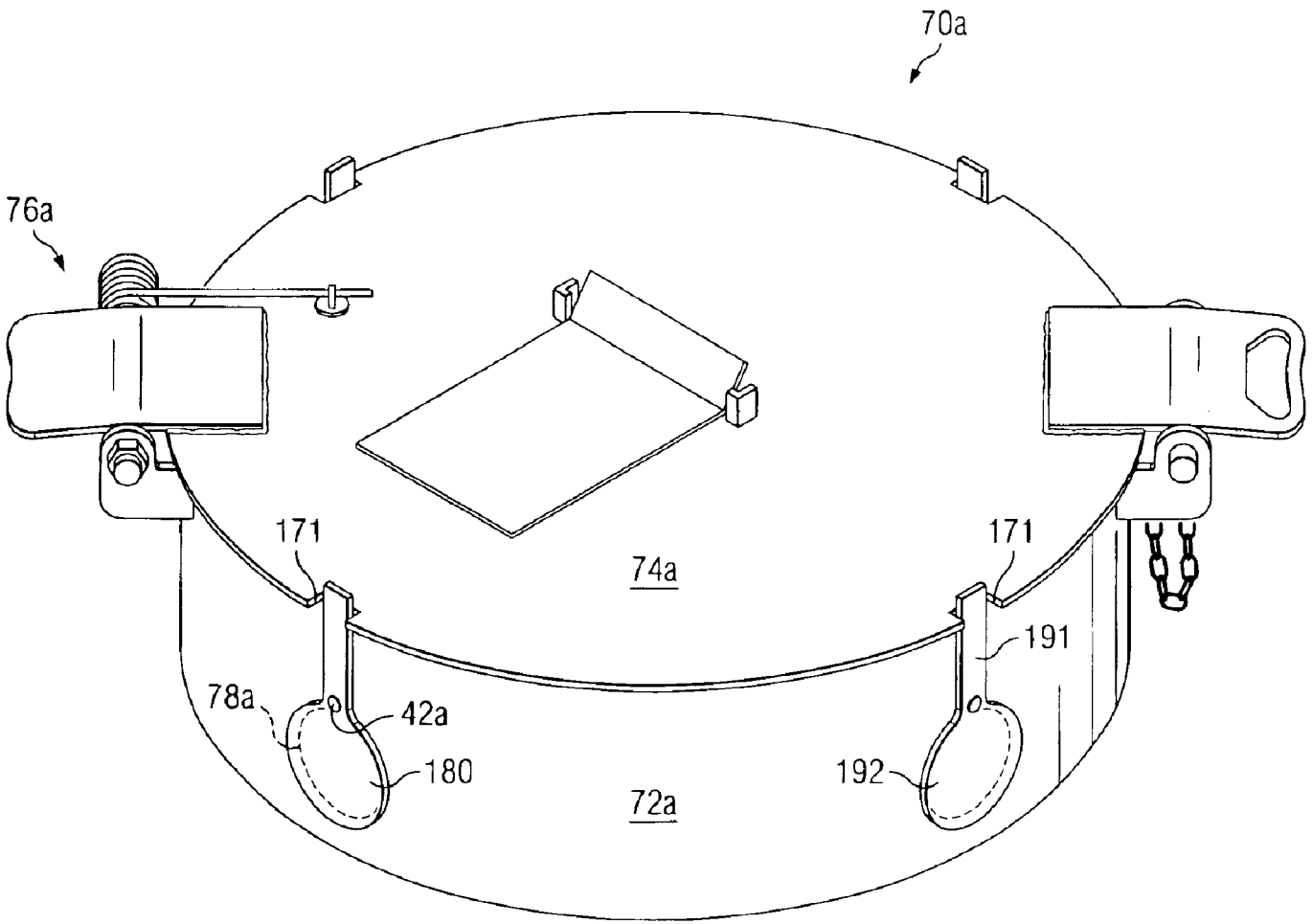
FIG. 4 is a schematic drawing illustrating an isometric view of an alternative embodiment protective housing assembly formed in accordance with the teachings of the present invention, in its first, closed position.

FIG. 4 illustrates an alternative embodiment of the present invention, as represented by protective housing assembly 70*a*. Protective housing assembly 70*a* may include cylindrical portion 72*a*, lid or normal access cover 74*a* and hinge assembly 76*a* having approximately the same overall dimensions and configurations as the corresponding components previously described with respect to protective housing assembly 70. In FIG. 4, normal access cover 74*a* is shown in its first, closed position (solid lines). Cylindrical portion 72*a* of protective housing assembly 70*a* may also include portholes 78*a* (shown in dotted lines) having approximately the same dimensions and configurations as previously described with respect to protective housing assembly 70.

Respective porthole covers 180 are pivotally or rotatably mounted on the exterior of cylindrical portion 72, adjacent to each porthole 78*a* by pivot pins 42*a*. Each porthole cover 80 preferably includes first portion 191 and second portion 192. First portion 191 may be generally described as having an elongated, rectangular configuration. Second portion 192 has a generally circular configuration. Pivot pins 42 are disposed through porthole covers 180 proximate the juncture between first portion 191 and second portion 102. The dimensions and configuration of second portion 192 are preferably selected to be greater than the associated porthole 78*a* such that when porthole covers 180 are in their first position, second portion 192 will block or restrict access through the respective porthole 78.

First portion 191 is generally rectangular in configuration. The shorter leg of the rectangle is relatively narrow, and approximately equal to one third of the diameter of second portion 192. The width (e.g., diameter) of second portion 192 is selected such that it is slightly larger than porthole 78*a*, and completely covers porthole 78*a* when porthole cover 180 is in the closed position. The configuration of porthole cover 180 reduces the overall size of porthole cover 180, for example by including the relatively thin, rectangular first portion 191. Accordingly, porthole cover is smaller, lighter, easier to handle and install, and easier to operate. However, it still effectively prevents unauthorized access to the interior portion of the protective housing assembly 70*a*.

Normal access cover 74*a* may have approximately the same configuration and dimensions as previously described with respect to protective housing assembly 70. However, normal access cover 74*a* may also be provided with a plurality of slots 171 which are formed in lid 74*a*. The location of each slot 171 may be selected to correspond with the location of porthole 78*a* in cylindrical portion 72*b*. The width of each slot 171 is selected to be slightly greater than the width of first portion 191 of the associated porthole cover 180. When lid or normal access cover 74*a* is in its first, closed position, a portion of porthole cover 180 will extend through respective slot 171. Engagement between first portion 191 and slot 171 prevents movement of porthole cover 180 from its first, closed position to its second, open position, when normal access cover or lid 74*a* is in its first, closed position.

This configuration allows for a rectangular first portion 191 having a relatively thin profile, and still protect unauthorized access to the interior of protective housing assembly 70*a*. In accordance with a particular embodiment of the present invention this configuration prevents an unauthorized user from bending the top edge of the porthole cover away from cylindrical portion 72 beyond the overhang of normal access cover 74 of FIGS. 10 and 11, which may provide unauthorized access to protective housing assembly 70, if the associated components were not sturdy enough.

Figure 5:
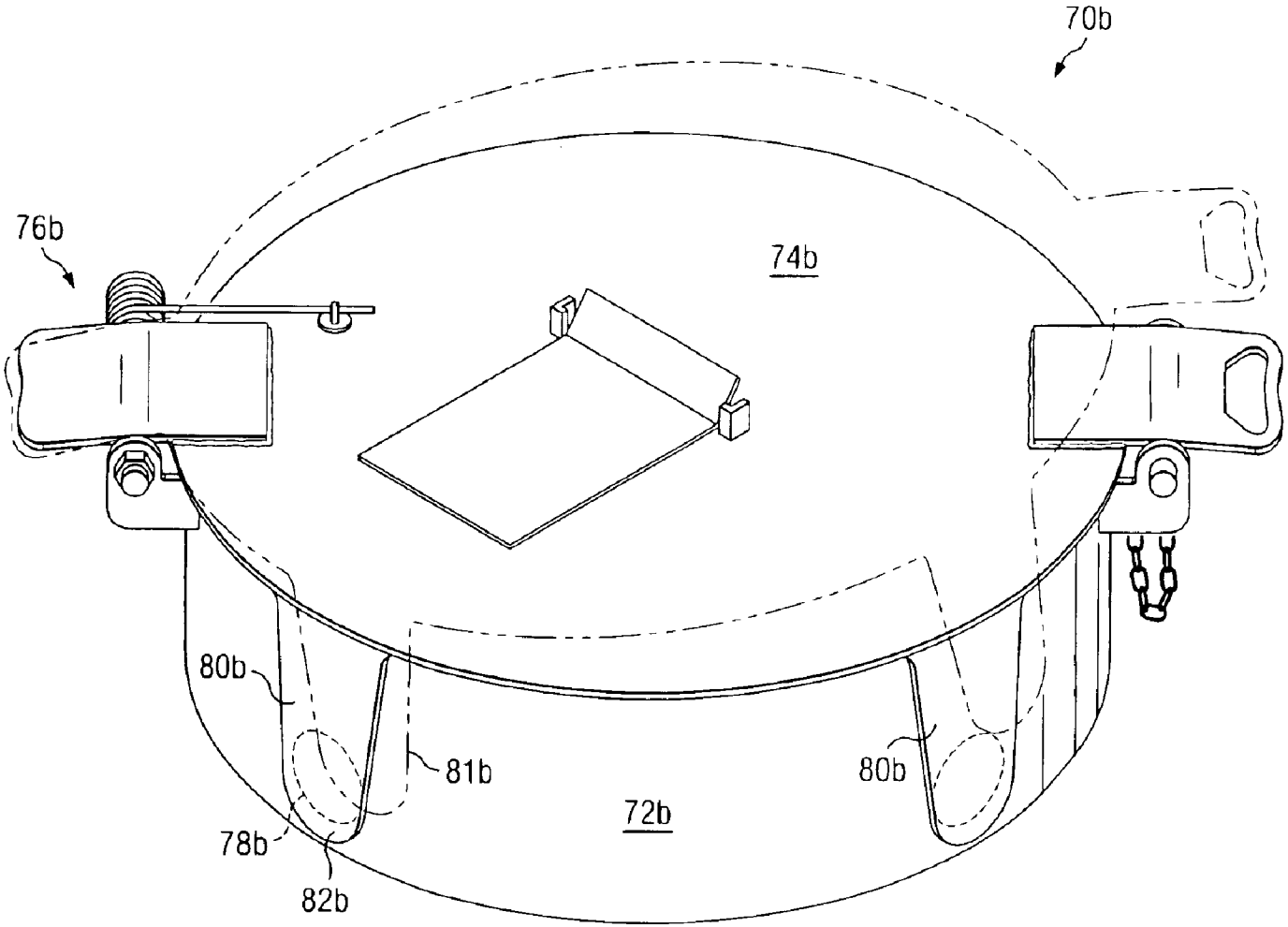
FIG. 5 is a schematic drawing illustrating an isometric view of another alternative embodiment protective housing assembly formed in accordance with the teachings of the present invention, in its first, closed position (dotted lines illustrated partially open position)

FIG. 5 illustrates another alternative embodiment of the present invention as represented by protective housing assembly 70*b*. Protective housing assembly 70*b* may include cylindrical portion 72*b*, normal access cover 74*b* and hinge assembly 76*b*, having approximately the same overall dimensions and general configurations as similar components previously described with respect to protective housing assembly 70. In FIG. 5, normal access cover 74*b* is shown in its first, closed position (solid lines) and its second, partially open position (dotted lines). Cylindrical portion 72*b* of protective housing assembly 70*b* may also include portholes 78*b* (shown in dotted lines) having approximately the same dimensions and configuration as previously described with respect to protective housing assembly 70.

For the embodiment of the present invention as shown in FIG. 5, respective porthole covers 80*b* may be formed as integral components of normal access cover 74*b*. For some applications, first ends 81*b* of each porthole cover 80*b* may be welded or otherwise bonded with the edge of normal access cover 74*b*. For other applications, porthole covers 80*b* may be formed from the same sheet of material which is used to form normal access cover 74*b*. The length of each porthole cover 80*b* from first end 81*b* to second end 82*b* may be approximately equal to, but less than the height of cylindrical portion 72*b*. The width of porthole covers 80*b* may vary from first end 81*b* to second end 82*b*. For example, in the illustrated embodiment, porthole cover 80*b* is wider proximate normal access cover 74*b* and tapers to a thinner portion at a lower end 82*b*.

When lid or normal access cover 74*b* is in its first, closed position, a portion of each porthole cover 80*b* will extend over and block access through respective portholes 78. When lid or normal access cover 74*a* is in its second, open position (dotted line position in FIG. 9) porthole covers 80*b* will be in their second position, which allows access through respective portholes 78*b*.

For some applications, protective housing assemblies 70*a* and 70*b* may have four portholes 78 formed therein and four porthole covers 180 and 80*b*. However, a protective housing assembly may be formed in accordance with teachings of the present invention having any number of portholes and porthole covers.

For some applications, a generally cylindrical skirt (not expressly shown) may be attached to and extend from a normal access cover similar to the relationship between porthole covers 80*b* and normal access cover 74*b*. Appropriate slots or openings (not expressly shown) may be provided in the cylindrical portion or skirt as required to accommodate hinge assembly 76 and locking mechanism 94. Examples of locking mechanisms satisfactory for use with the present invention are shown in FIGS. 2–6.

Figure 3C:
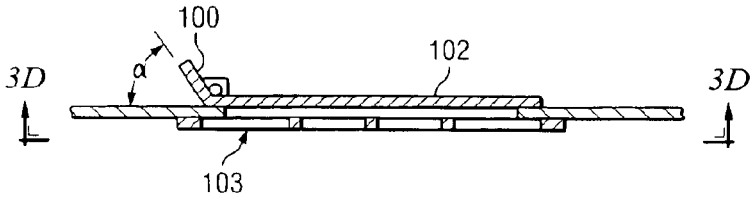
FIG. 3C is a partial, cross-sectional view, with portions broken away, illustrating a normal access cover suitable for use within the teachings of the present invention, which includes an optional vent opening cover and anti-access device.

Vent opening cover 88 is illustrated in more detail in FIG. 3C. Vent opening cover 88 provides partial access to vent opening 86, without allowing unauthorized access. Vent opening 86 may be disposed above a safety valve vent similar to vent 28 of FIG. 1. The safety valve vent is used as a safety precaution to allow the release of any tank contents that are vented through a safety valve associated with the tank car.

Traditional safety vent covers allowed for unauthorized access to the interior of protective housing assembly 70. Vent opening cover 88 is configured such that it may only be opened partially, but still allows for safe venting of gas and liquids from the interior of protective housing assembly 70.

Vent opening cover 88 may have a similar configuration to previous vent covers and those described in this specification. However, vent opening cover includes an extension leg 100 that is disposed at an acute angle $\alpha$ to an adjacent portion of normal access cover 74. Thus, when vent opening cover 88 is lifted, extension leg 100 cooperates with normal access cover 74 to prevent vent opening cover 88 from being opened beyond an amount where the angle between main plate 102 of vent opening cover 88 and the surface of normal access cover 74 exceeds the angle $\alpha$.

Thus, vent opening cover 88 prevents access to the interior of the fittings protective housing through the protective housing vent, while the protective housing cover is closed and pinned. Permanent application of this semi-open closure prevents access to the interior of protective housing assembly 70 (when normal access cover 74 is locked, latched, or otherwise pinned), while still allowing mandatory venting of the protective housing assembly.

Figure 3D:
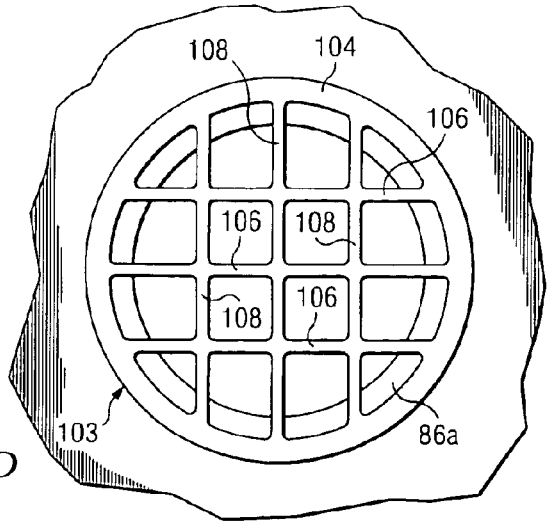
FIG. 3D is a schematic view in elevation, viewed from below, and illustrates the anti-access device of FIG. 3C.

An anti-access device 103 suitable use in a particular embodiment of the present invention is illustrated in FIGS. 3C and 3D. Anti-access device 103 can be of solid construction (e.g., cast or sheet metal), or multi-piece such as a ring with wire cross members, or wire cross members attached directly to the bottom side of the vent opening cover 88.

As is most evident in FIG. 3D, anti-access device 103 comprises a ring 104 having wire cross members 106 extending thereacross. Another set of wire cross member 108 extend across ring 104 and are oriented generally perpendicular with wire cross members 106.

It should be recognized by those of ordinary skill in the art that anti-access device 103 is an optional component. Anti-access device 103 may be particularly suited for applications in which restrictions 90 and 91 are not formed in normal access cover 74. In this embodiment, vent opening 86 will form a circular opening, as illustrated by opening 86*a* of FIG. 3D. As further evident from FIGS. 3C and 3D, anti-access device 103 is an optional component that may be attached to an interior surface of normal access cover 74, to prevent unauthorized access to valves.

Figure 6A:
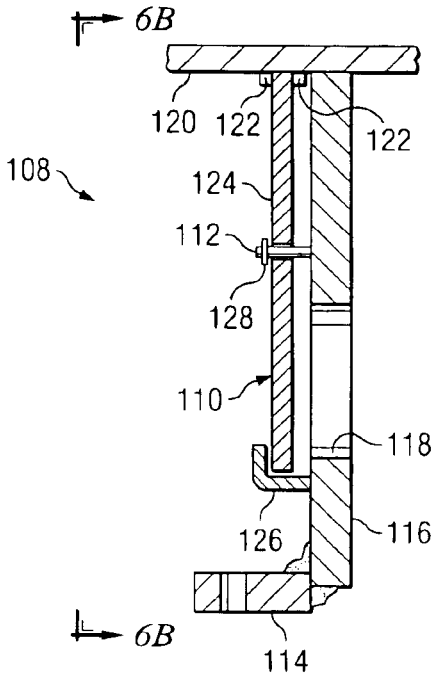
FIG. 6A is a cross-sectional view of an alternative embodiment protective housing assembly, including components suitable for use within the teachings of the present invention.
Figure 6B:
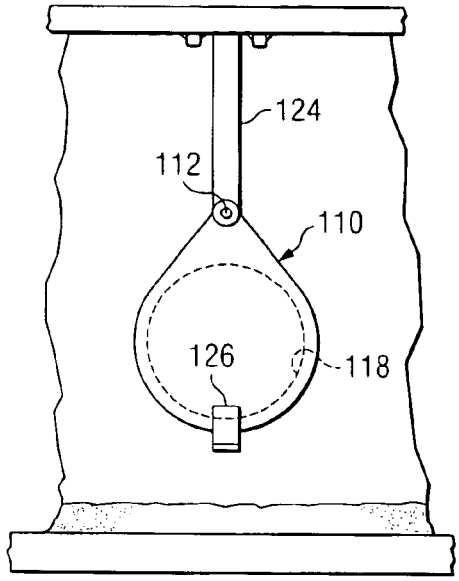
FIG. 6B is a schematic drawing in elevation illustrating components of FIG. 6A in more detail.

An alternative configuration for a porthole cover 110, pivot pin 112, and associated components of porthole cover 110, is illustrated in FIGS. 6A and 6B. FIG. 6A illustrates a mounting flange 114 that is used to secure protective housing assembly 108 to a tank car or other type of tank fitting. A cylindrical portion 116 of protective housing assembly 108 may be configured similarly to other cylindrical portions, or sidewalls described herein. Such a cylindrical portion includes a porthole at the location designated by the reference number 118. A normal access cover 120 is also provided, that is similar in configuration to other normal access covers described within this specification.

Porthole cover 110 protects protective housing assembly 108 from unauthorized access by a user, since the porthole cover 110 is mounted inside the protective housing assembly, out of reach of the user when normal access cover 120 is in a closed position. The purpose of porthole cover 110 is to prevent access to the interior of the fittings' protective housing through the porthole, while the protective housing lid is closed and/or pinned. The design is similar to others described within this specification, except that the porthole cover 110 is installed on the inside of the housing. Also, protective housing assembly 108 of FIG. 6A, includes two retainer lugs 122. Retainer lugs 122 are situated on either side of an anti-pivot tail 124 that is integral to porthole cover 110. As illustrated in FIGS. 6A and 6B, as normal access cover 120 is closed, retainer lugs 122 trap anti-pivot tail 124 in a space between retainer lugs 122, preventing the porthole cover from opening. Thus, normal access cover 120 must be in an open position (at least partially) in order for porthole cover 110 to be free to rotate away from porthole 118, and provide access to any valves within protective housing assembly 108.

Protective housing assembly 108 also includes an anti-bending lug 126 that prevents porthole cover 110 from being bent inwardly, with respect to cylindrical portion 116. Anti-bending lug 126 may be sized, configured, and formed from materials similar to anti-bending lug 96 of FIG. 3B. A washer 128 is provided upon pivot pin 112, in order to maintain porthole cover 110 pivotally mounted upon pivot pin 112.

Figure 7A:
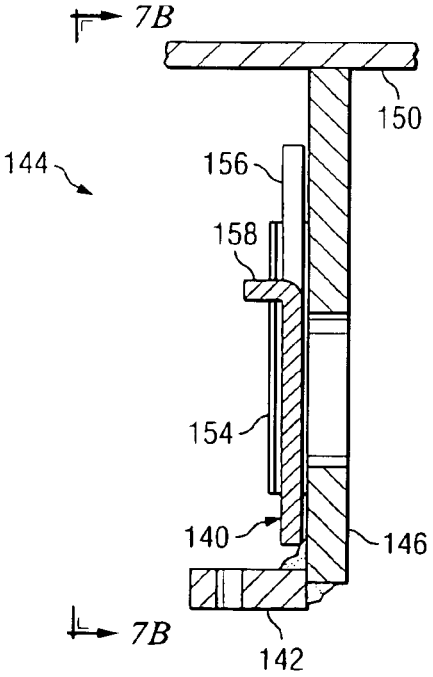
FIG. 7A is a cross-sectional view of an alternative embodiment protective housing assembly, including components suitable for use within the teachings of the present invention.
Figure 7B:
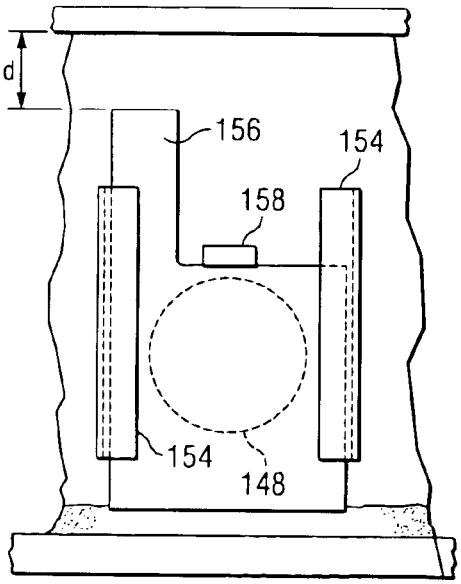
FIG. 7B is a schematic drawing in elevation, with portions broken away, illustrating components of the protective housing assembly of FIG. 7A in more detail.

Another alternative configuration for a porthole cover 140, and associated components of porthole cover 140, are illustrated in FIGS. 7A and 7B. FIG. 7A illustrates a mounting flange 142 that is used to secure protective housing assembly 144 to a tank car or other type of tank fitting. A cylindrical portion 146 of protective housing assembly 144 may be configured similarly to other cylindrical portions, or sidewalls described herein. Such a cylindrical portion includes a porthole 148 (dotted lines in FIG. 7B). A normal access cover 150 is also provided, that is similar in configuration to other normal access covers described within this specification.

Porthole cover 140 protects protective housing assembly 144 from unauthorized access by a user, since the porthole cover 140 is mounted inside the protective housing assembly, out of reach of the user when normal access cover 150 is in a closed position. The purpose of porthole cover 140 is to prevent access to the interior of the fittings protective housing through the porthole, while the protective housing lid is closed and/or pinned.

A pair of retainer guides 154 are coupled with cylindrical portion 146, and configured to allow porthole cover 140 to slide vertically, with respect to cylindrical wall 146. The configuration of porthole cover 140 is such that a lifting stop 156 protrudes upward toward normal access cover 150, to within a distance d of a lower edge of normal access cover 150. A lifting tab 158 protrudes inward from porthole cover 140. Lifting tab 158 provides a surface for a user to engage porthole cover 140, and slide porthole cover 140 upward with respect to cylindrical wall 146.

In operation, when normal access cover 150 is in its closed position, porthole cover 140 will only be free to slide vertically a distance d, before lifting stop 156 engages a lower edge of normal access cover 150. Thus, as long as normal access cover 150 is in its closed position, porthole cover 140 cannot be lifted by an amount sufficient to expose porthole 148. Accordingly, an unauthorized user cannot gain access to the interior of protective housing assembly 144, through porthole 148, while normal access cover 150 is pinned and/or locked in a closed position.

Various materials may be used to form the various components of the protective housing assemblies described herein. For example, various metals, plastics, composites and/or metal alloys may be used. The particular material selected may be based upon the type of material carried in the associated tank. Furthermore, the specific type of material may be recommended or required by various governing bodies that control the transportation of materials carried in the tank, for example the American Association of Railroads (AAR).

Although the present invention and its advantages have been described in detail, it should be understood that various changes, substitutions and alterations can be made herein without departing from the spirit and scope of the invention as defined by the following claims.

What is claimed is:

1. A railway tank car having a manway formed in an upper portion of the tank car, the tank car comprising;

a manway cover coupled to the manway;

at least one valve coupled to the manway cover and operable to discharge fluids from the tank car;

a protective housing assembly coupled to the upper portion of the railway tank car and disposed around the manway cover and valve;

the protective housing assembly having a normal access cover operable to prevent unauthorized access to the manway cover and the at least one valve;

the normal access cover having a first, closed position which prevents unauthorized access to the manway cover and the at least one valve;

the normal access cover having a second, open position which allows access to the manway cover and the at least one valve;

at least one porthole formed in a side wall of the protective housing assembly;

the porthole providing access to operate the at least one valve;

a porthole cover having a first position which blocks access through the porthole to the valve and a second position which allows access through the porthole to the valve;

the porthole cover engaged with the normal access cover to prevent movement of the porthole cover to its second position when the access cover is in its first position; and the normal access cover allowing movement of the porthole cover to its second position when the normal access cover is in its second position.

2. The railway tank car of claim 1, wherein the sidewall comprises a generally hollow, cylindrical portion and the protective housing assembly further comprises;

the cylindrical portion; and a hinge assembly for rotatably coupling the normal access cover with the cylindrical portion.

3. The railway tank car of claim 1, wherein the at least one valve comprises two or more valves disposed on the manway cover, the valves being operable to discharge fluids from the tank car, and further comprising a respective porthole formed in the protective housing assembly for each of the two or more valves.

4. The railway tank car of claim 1, wherein the porthole cover is rotatably secured to an exterior surface of the protective housing assembly, adjacent to the porthole.

5. The railway tank car of claim 1, wherein the porthole cover is slideably disposed on an exterior surface of the protective housing assembly, adjacent to the porthole.

6. The railway tank car of claim 1, wherein the porthole cover is slideably secured to an interior surface of the protective housing assembly, adjacent to the porthole.

7. The railway tank car of claim 1, wherein the at last one valve comprises a safety valve coupled to the manway cover and operable to discharge fluids from the tank car when fluid pressure within the tank car exceeds a selected value, and further comprising:

a vent opening formed in the normal access cover to allow the fluids discharged from the safety valve to exit from the protective housing assembly; and a restriction engaged with the vent opening in the normal access cover to block access therethrough while still allowing fluids to exit from the protective housing assembly.

8. The railway tank car of claim 7, wherein the restriction further comprises a plurality of bars formed as integral components of the normal access cover and spaced from each other to allow fluid flow therebetween while blocking access through the vent opening in the normal access cover.

9. The railway tank car of claim 7, wherein the restriction further comprises a screen engaged with an interior surface of the normal access cover adjacent to the vent opening to allow fluid flow through the screen while blocking access through the opening in the normal access cover.

10. The railway tank car of claim 1, further comprising:

the porthole cover being rotatably secured with the protective housing assembly;

a slot formed in the normal access cover;

the slot sized to receive a portion of the porthole cover therein when the normal access cover is in its first, closed position; and wherein engagement between the porthole cover and the slot prevent rotation of the porthole cover when the normal access cover is in the first, closed position.

11. The railway tank car of claim 1, wherein the at least one porthole comprises at least four portholes formed in the sidewall of the protective housing assembly, each porthole having an associated porthole cover, each porthole cover having a first position which blocks access through one of the respective portholes to the valve, and a second position which allows access through the respective porthole, and further comprising:

at least four slots formed in the normal access cover;

each slot sized to receive a respective portion of one of the porthole covers when the normal access cover is in its first, closed position; and wherein engagement between the porthole covers and the respective slots prevent rotation of the porthole covers from the first positions to the second positions when the normal access cover is in its first, closed position.

12. A protective housing assembly for a tank, comprising;

a generally hollow, cylindrical wall portion sized to fit over a manway formed in an upper portion of a tank and at least one valve secured to an associated manway cover;

a normal access cover disposed on the cylindrical wall portion;

the normal access cover having a first, locked position which prevents unauthorized access to the manway cover and the valve;

the normal access cover having a second position which allows access to the manway cover and the valve;

at least one porthole formed in the cylindrical wall portion to allow access therethrough to the valve; and a porthole cover engaged with the normal access cover to block access through the porthole when the normal access cover is in its first position, and to allow access through the porthole when the normal access cover is in its second, open position.

13. A protective housing assembly, comprising:

a cylindrical sidewall configured to be coupled with a tank to generally surround at least one valve of the tank;

an access cover configured to be removably disposed over the cylindrical sidewall, a diameter of the access cover being larger than a diameter of the cylindrical sidewall, such that an outer portion of the access cover overhangs the cylindrical sidewall, when the access cover is in a closed position;

a hinge assembly coupled to the cylindrical sidewall and the access cover, the hinge assembly configured to allow the access cover to be moved to an open position wherein an interior portion of the cylindrical sidewall is exposed to a user;

the cylindrical sidewall having at least one porthole disposed therein;

a porthole cover having a first position in which the porthole cover covers the porthole, and a second position in which the porthole is exposed; and wherein the access cover prevents the porthole cover from being moved from the first position to the second position, when the access cover is in the closed position.

14. The protective housing assembly of claim 13, further comprising:

a pivot pin being disposed through the porthole cover and coupled to the cylindrical wall, the pivot pin allowing rotation of the porthole cover from the first position to the second position.

15. The protective housing assembly of claim 14, wherein the porthole cover is disposed upon an exterior surface of the cylindrical wall and wherein the outer portion of the access cover cooperates with an upper edge of the porthole cover to prevent the porthole cover from being rotated from the first position to the second position, when the access cover is in the closed position.

16. The protective housing assembly of claim 14, wherein the access cover forms at least one slot in the outer portion, and wherein an upper portion of the porthole cover is disposed in the slot to prevent rotation of the porthole cover from the first position to the second position, when the access cover is in the closed position.

17. The protective housing assembly of claim 13, further comprising an anti-bending lug being coupled with the cylindrical wall, the anti-bending lug forming a slot between the cylindrical wall and a leg of the anti-bending lug, the slot being configured to allow the porthole cover to slide therethrough, but prevent prying of the porthole cover away from the cylindrical wall.

18. The protective housing assembly of claim 13, wherein the porthole cover is disposed upon an interior surface of the cylindrical wall.

19. The protective housing assembly of claim 18, wherein the porthole cover includes a anti-pivot tail extending toward the access cover, and further comprising:

a pair of retainer lugs extending from the access cover, the retainer lugs forming a space configured to receive the anti-pivot tail, and prevent rotation of the porthole cover from the first position to the second position, when the access cover is in the closed position.

20. A protective housing assembly, comprising:

a cylindrical sidewall configured to be coupled with a tank to generally surround at least one valve of the tank;

an access cover configured to be removably disposed over the cylindrical sidewall, when the access cover is in a closed position;

a hinge assembly coupled to the cylindrical sidewall and the access cover, the hinge assembly configured to allow the access cover to be moved to an open position wherein an interior portion of the cylindrical sidewall is exposed to a user;

the cylindrical sidewall having at least one porthole disposed therein;

a porthole cover having a first position in which the porthole cover covers the porthole, and a second position in which the porthole is exposed;

the porthole cover including a lifting stop that extends toward the access cover, to limit vertical movement of the porthole cover when the access cover is in the closed position;

a pair of retainer guides disposed upon an interior surface of the cylindrical sidewall, the retainer guides being configured to allow vertical movement of the porthole cover; and wherein the access cover prevents the porthole cover from being moved from the first position to the second position, when the access cover is in the closed position.

21. The protective housing assembly of claim 20, further comprising a lifting tab extending inward from the porthole cover and providing a surface for a user to engage in order to lift the porthole cover from the first position to the second position.

* * * * *